US005860052A

United States Patent [19]

Ohtsuka et al.

[11] Patent Number: 5,860,052

[45] Date of Patent: Jan. 12, 1999

[54] IMAGE HEATING APPARATUS

[75] Inventors: Yasumasa Ohtsuka, Toride; Yohji Tomoyuki, Ichikawa; Hideyuki Yano, Numazu; Manabu Takano, Tokyo; Mahito Yoshioka; Osamu Mukataka, both of Toride; Kenichi Ogawa, Kashiwa; Yasunari Watanabe, Kunitachi, all of Japan

[73] Assignee: Canon Kabushiki Kaisha, Tokyo, Japan

[21] Appl. No.: 688,643

[22] Filed: Jul. 29, 1996

[30] Foreign Application Priority Data

Jul. 28, 1995 [JP] Japan ..... 7-212698

[51] Int. Cl.[6] ..... G03G 15/20

[52] U.S. Cl. ..... 399/329; 399/328; 219/216; 219/494

[58] Field of Search ..... 399/329, 328; 219/216, 543, 494

[56] References Cited

U.S. PATENT DOCUMENTS

| | | | |
|---|---|---|---|
| 5,083,168 | 1/1992 | Kusaka et al. . | |
| 5,162,634 | 11/1992 | Kusaka et al. | 219/216 |
| 5,171,145 | 12/1992 | Kusaka et al. | 432/59 |
| 5,196,895 | 3/1993 | Setoriyama et al. | 399/328 |
| 5,262,834 | 11/1993 | Kusaka et al. | 399/329 |
| 5,267,005 | 11/1993 | Yamamoto et al. | 399/329 |
| 5,288,973 | 2/1994 | Ota et al. | 219/216 |
| 5,300,998 | 4/1994 | Ogisawa et al. | 399/124 |
| 5,300,999 | 4/1994 | Koh et al. | 399/329 |
| 5,309,210 | 5/1994 | Yamamoto et al. | 399/329 |
| 5,365,321 | 11/1994 | Koshimizu et al. | 399/329 |
| 5,367,369 | 11/1994 | Nakai et al. | 399/69 |
| 5,386,281 | 1/1995 | Mitani et al. | 399/329 |
| 5,493,379 | 2/1996 | Kuroda et al. | 399/335 |
| 5,546,161 | 8/1996 | Sakai et al. | 399/16 |

FOREIGN PATENT DOCUMENTS

| | | |
|---|---|---|
| 0372479 | 6/1990 | European Pat. Off. . |
| 0443799 | 8/1991 | European Pat. Off. . |
| 0604976 | 7/1994 | European Pat. Off. . |
| 63-313182 | 12/1988 | Japan . |
| 1-263679 | 10/1989 | Japan . |
| 2-157878 | 6/1990 | Japan . |
| 4-044075 | 2/1992 | Japan . |
| 4-044076 | 2/1992 | Japan . |
| 4-044077 | 2/1992 | Japan . |
| 4-044078 | 2/1992 | Japan . |
| 4-044079 | 2/1992 | Japan . |
| 4-044080 | 2/1992 | Japan . |
| 4-044081 | 2/1992 | Japan . |
| 4-044082 | 2/1992 | Japan . |
| 4-044083 | 2/1992 | Japan . |

*Primary Examiner*—Matthew S. Smith
*Attorney, Agent, or Firm*—Fitzpatrick, Cella, Harper & Scinto

[57] ABSTRACT

An image heating apparatus includes a heater provided with a heat generating element generating heat upon electric energization to a base; a supporting member for supporting the heater; a back-up member press-contacted to the heater; wherein an image on a recording material is heated by heat from the heater; wherein at least such a portion of the supporting member as supports the heater is of thermoplastic material.

31 Claims, 9 Drawing Sheets

FIG. 4(a)
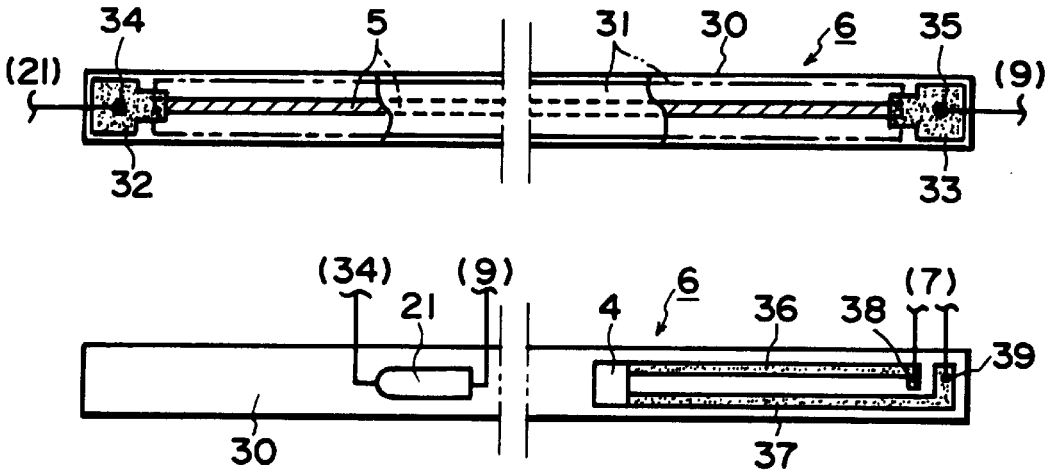
FIG. 4(b)
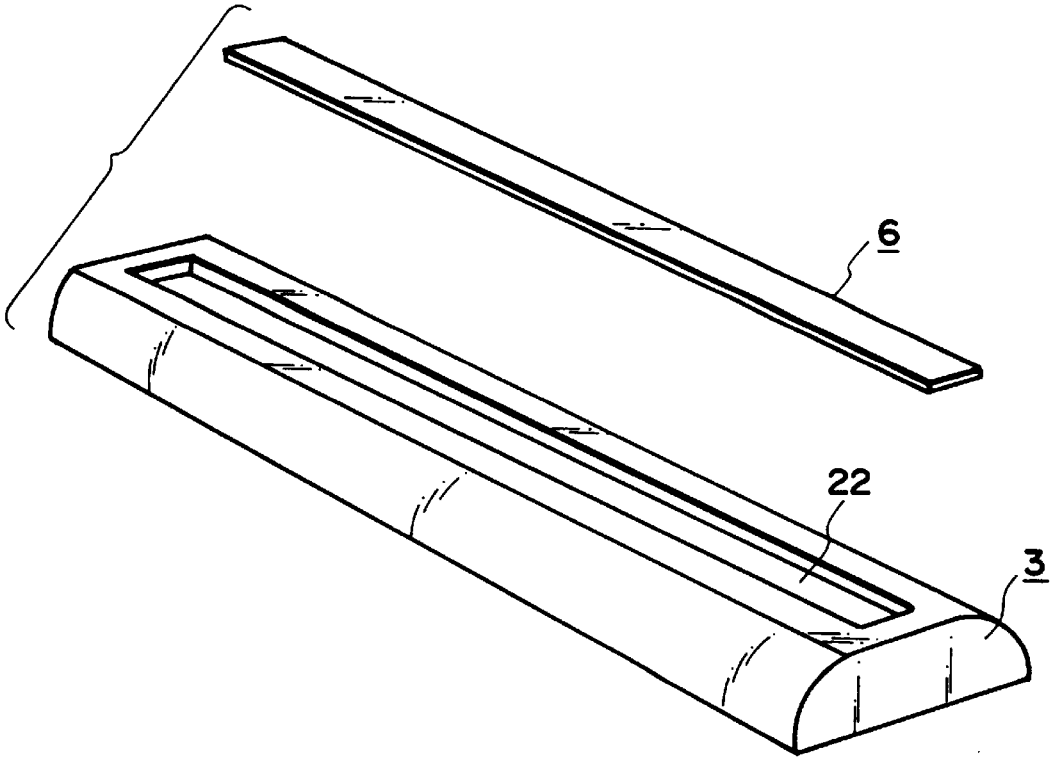
FIG. 5

IMAGE HEATING APPARATUS

FIELD OF THE INVENTION AND RELATED ART

The present invention relates to an image heating apparatus usable with an image forming apparatus such as copying machine and printer, and more particularly to a image heating device wherein a heating element per se is broken at the time of abnormal temperature rise of the heating element.

A film heating type heating device has been proposed by the assignee of this application in Japanese Laid Open Patent Application No. SHO-63-313182, Japanese Laid Open Patent Application No. HEI-1-263679 Japanese Laid Open Patent Application No. HEI-2-157878, Japanese Laid Open Patent Application No. HEI-4-44075-44083 or the like.

In this heating device, a heating element having a heat generating element generating heat upon energization thereto is supported on a supporting member, and the heating element and an elastic pressing roller as a pressing member are pressed to each other with a heat resistive film material (or sheet material) therebetween to form a heating nip. Between the pressing roller and the heat resistive film material, a member to be heated is introduced and is fed through the nip together with the heat resistive film material by which thermal energy of the heating element is applied to the member to be heated through the heat resistive film material in the heating nip. This type is advantageous in that the used heating element has a low thermal capacity with high temperature rise speed (quick start feature) and can concentratedly apply the heat.

The heating device is usable as an image heating device for the image fixing in an image forming apparatus such as copying machine or printer, more particularly as a heating device for heat-fixing, into a permanent fixed image, an unfixed toner image formed and carried on a recording material (transfer material photosensitive paper electrostatic recording paper or the like) through an image formation process (transfer type or direct type) such as electrophotographic process, electrostatic recording process, or magnetic recording.

As an example of a heating element having a low thermal capacity with high temperature rise speed, there is a so-called ceramic heater having a high thermal conductivity ceramic substrate of heat-resistivity and insulative property, and a heat generating resistor printed or sintered thereon. The electric power is supplied to the heat generating resistor to generate heat.

The electric power supply to the heat generating resistor is controlled so as to maintain a predetermined temperature, 160°–180° C. in an image heat-fixing device, by a temperature control system including a temperature sensing element (thermister or the like) for detecting the temperature of the heater.

As a measure for safety, a safety element such as temperature fuse is connected in series with the heat generating resistor in the electric energy supply system therefor, and is contacted to the back side of the heater similarly to thermister.

Upon breakdown of the temperature sensing element such as thermister in the temperature control system, or the electric power control system such as AC driver or TRIAC in the electric energy supply system for the A/D converter, control means (CPU) or the heat generating resistor, electric power may be supplied to the heat generating resistor of the heater without control. If this occurs, the heater temperature may continuously rise (runaway of the heater).

As a redundant safety measure in consideration of the failure or disorder of the safety element such as the fuse, means is provided to spontaneously let the heater crack with disconnection in the AC line (the heat generating resistor per se and the electroconductive path connected therewith).

More particularly, the heater is provided with a weakened portion in the form of an opening or scribed groove to cause thermal stress in the heater to be concentrated on the weakened portion upon the over-heat state due to the runaway so as to stop the runaway by letting the heater cracking occur which leads to disconnection of the AC line.

In this case, the way of cracking or the cracking position of the heater is important. For example, the way of cracking or cracking position which does not result in the disconnection of the AC line, which does not break the insulation between the AC line and the DC line (thermister and electroconductive path therefor formed on the heater), or which only disconnects the DC line, cannot stop the runaway of the heater.

The heater weakened portion is provided so as to assure the stop of the heater runaway.

However, when the weakened portion is formed in the heater as the redundant measure, the yield decreases in the manufacturing process of the heater per se since the heater is relatively easily broken at the weakened portion.

SUMMARY OF THE INVENTION

Accordingly, it is a principal object of the present invention to provide an image heating device wherein thermal damage of the device is prevented by break or rupture of the heater without decreasing the yield of the heater.

It is another object of the present invention to provide an image heating device wherein at least a supporting portion for the heater in the supporting member for supporting the heater is made of thermoplastic material.

It is a further object of the present invention to provide an image heating device wherein the supporting member is provided, at an end portion in the longitudinal direction of a recess for receiving the heater, with a step.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4, (a) is a partly broken plan view of a heater (ceramic heater), and (b) is a back side view.

FIG. 5 is an exploded perspective view of a heater and a heater supporting member.

DESCRIPTION OF THE PREFERRED EMBODIMENTS

Referring to the accompanying drawings, the embodiments of the present invention will be described.

Embodiment 1 (FIG. 1–FIG. 5)

(1) Example of Image Forming Apparatus

Figure 1:
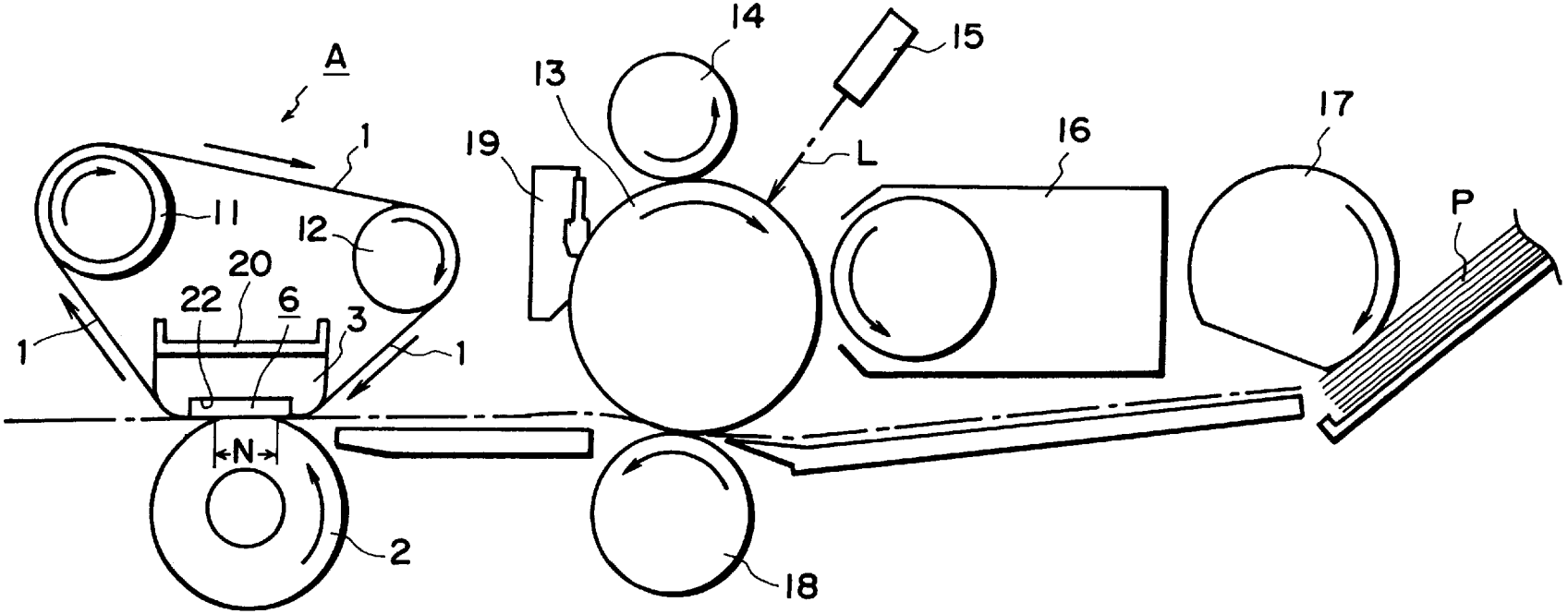
FIG. 1 is a schematic illustration of an example of the image forming apparatus.

FIG. 1 shows example of an image forming apparatus in which present invention is used. The image forming apparatus of this example is a laser beam printer using an image transfer type electrophotographic process. Designated by 13 is an electrophotographic photosensitive member of a rotatable drum type as an image bearing member, and is rotated at a predetermined peripheral speed (process speed) in the clockwise direction indicated by the arrow. The photosensitive member 13 of this example is an OPC photosensitive member having a diameter of 30 mm, and is rotated at 25 mm/sec.

Designated by 14 is a contact type charging roller as a primary charging means contacted to the photosensitive member 13. The charging roller 14 is supplied with a predetermined charging bias voltage from a charging bias voltage source, so that the peripheral surface of the rotatable photosensitive member 13 is uniformly charged (primary charging). In this example, it is charged to −650 V.

The charged surface of the rotatable photosensitive member is subjected to scanning exposure by a laser beam emitted from a laser diode 15 of a laser scanner with modulation in accordance with image information signal representative of the intended image (image exposure) L, so that an electrostatic latent image is formed on the surface of the rotatable photosensitive member 13.

Then, the electrostatic latent image is developed into a toner image by a developing device 16. In this example, the developing device is a reverse jumping development type using magnetic one component toner.

On the other hand, a transfer material P as a recording material is fed one by one into the device from a sheet feeding tray by driving a sheet feeding roller 17, and is introduced into a nip between a transfer roller 18 and a photosensitive member 13 at a predetermined timing, and the toner image on the surface of the introduction is continuously transferred onto the introduced transfer material surface. The transfer roller 18 is supplied with a predetermined transfer bias from an unshown transfer bias voltage source.

The transfer material P having passed through the transfer portion, is separated from the surface of the rotatable photosensitive member 13, and is introduced into the heat-fixing device A so that the unfixed toner image is fixed, and then, the transfer material is discharged.

The surface of the photosensitive member 13 after the separation of the transfer material, is cleaned by a cleaning blade of urethane rubber contacted to the surface of the photosensitive member 13 in a cleaning device 19 so that the residual matter such as untransferred toner is removed to be prepared for repeated image forming operation.

(2) Heat-fixing Device A

The heat-fixing device A of this example is of a film heating type using a heat resistive film material (heat resistive sleeve) in the form of an endless belt type.

Figure 2:
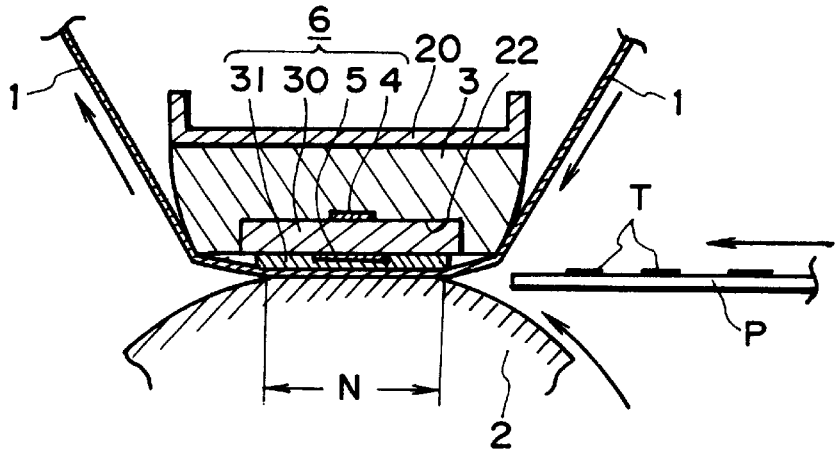
FIG. 2 is an enlarged cross-sectional view of a major part of an image heat-fixing device using a film type heating device.
Figure 3:
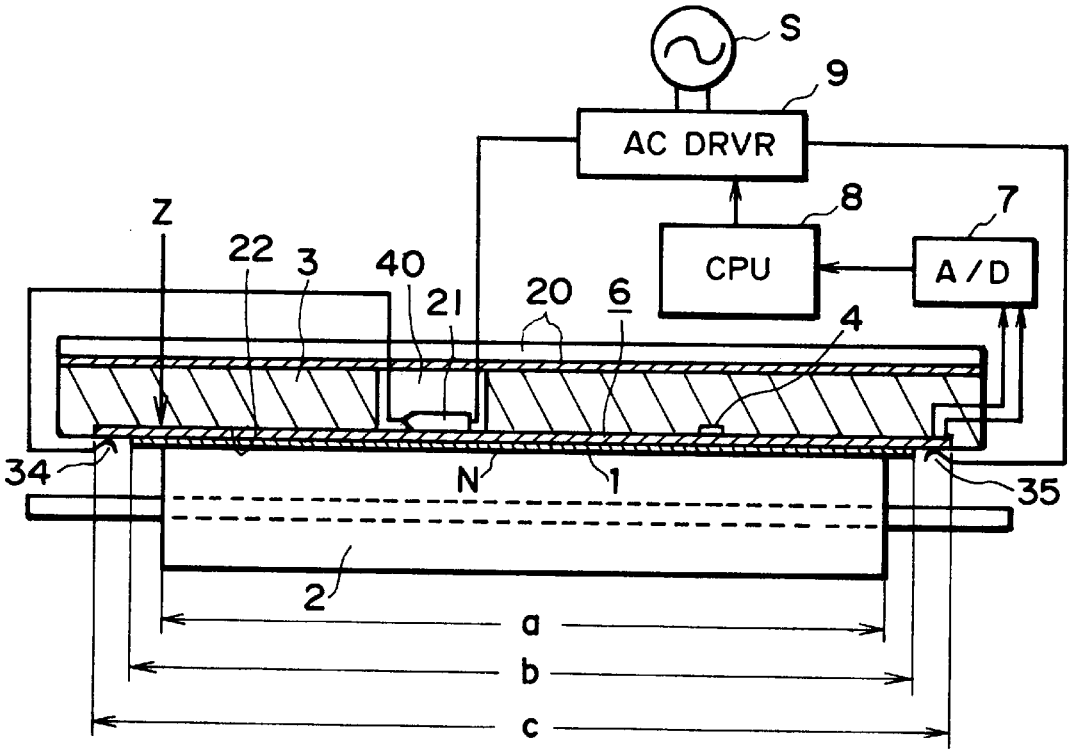
FIG. 3 is a longitudinal section of the same device.

FIG. 2 is an enlarged cross-sectional view of a major part; FIG. 3 is a longitudinal sectional view of the major part; FIG. 4, (a) shows a heater, (b) shows a back side; FIG. 5 is an exploded perspective view of the heater as the heating element and the heater supporting member.

Designated by 6 is a heater. The heater of this example is an elongated flat plate-like ceramic heater extending in a direction perpendicular to the transporting direction of the transfer material as a member to be heated introduced into the device. It is a low thermal capacity heater which rapidly increases the temperature upon energization to the heat generating resistor 5, which will be described hereinafter.

Designated by 3 is an elongated heater supporting member as a heating element supporting member, and the heater 6 is embedded to a counterbore 22 in the form of a recess extended in the longitudinal direction in the bottom surface of the heater supporting member 3 with the heater at the outside. The heater 6 may be bonded to the counterbore 22 of the heater supporting member 3 or may be simply fitted. The heater supporting member 3 is of a thermoplastic resin material, for example, a liquid crystal polymer, PPS or the like, which has a heat-resistivity of not less than 200° C. and is plasticized at a temperature not less than 250° C.

The configuration is maintained by a reinforcing plate 20 of channel-like shape cross-section on the upper surface side (the side opposite from the heater support side) of the heater supporting member 3.

The assembly of the heater 6, supporting member 3 and reinforcing plate 20, is fixed on an unshown supporting member with the heater 6 facing down.

Designated by 11 and 12 are a driving roller and a tension roller disposed in parallel with the assembly of the heater 6, the supporting member 3 and the reinforcing plate 20.

Designated by 1 is a heat resistive film material (fixing film) in the form of an endless belt, and stretched around the heater 6, driving roller 11 and the tension roller 12.

The fixing film 1 may be a monolayer film of PTFE, PFA or the like or a complex layer film comprising a base film of polyimide, polyamide-imide, PEEK, PES PPS or the like and a parting layer of PTFE, PFA, FEP or the like. It has a total thickness 100 $\mu$m, preferably, 20–40 $\mu$m and has a heat-resistivity, parting property, strength and durability.

Designated by 2 is a pressing roller as a pressing member or a back-up member having a heat resistive elastic layer with high parting property such as silicone rubber. It is press-contacted, with a predetermined urging force against the elastic layer, to the lower surface of the heater 6 with the fixing film 1 therebetween, thus forming a heating nip portion N of a predetermined width (fixing nip).

By rotation of the driving roller 11, the fixing film 1 is rotated in the clockwise direction indicated by the arrow, at least during the image fixing operation, at a predetermined peripheral speed (the same as the feeding speed of the transfer material P introduced into the device A) while sliding on the bottom surface of the heater in close contact with the bottom surface of the heater 6. The pressing roller 2 is driven by the rotation of the fixing film 1.

In the state that the fixing film 1 is rotated and that the heater 6 is controlled at a predetermined temperature by the electric power supply to the heat generating resistor 5 of the heater 6, the transfer material P is introduced to between the fixing film 1 of the fixing nip N and the pressing roller 2, so that the transfer material P is passed through the fixing nip N while the transfer material P is kept in close contact with the fixing film 1.

In the fixing nip passing process, thermal energy is applied to the transfer material P through the fixing film 1 from the heater 6, so that the unfixed toner image T on the transfer material P is heated, fused and fixed. The transfer material P is separated from the fixing film 1 after passing the fixing nip, and is discharged.

The film heating type is advantageous in that a very low thermal capacity heater 6 is usable so that the time required for reaching the predetermined heating temperature can be significantly reduced.

In addition, it is easy to increase the temperature to a high temperature from the normal temperature, and therefore, there is no need of stand-by temperature control when the device is in the stand-by state without printing operation.

Referring to FIG. 4, the constituent elements of the ceramic heater 6 will be described.

The heater substrate is a ceramic substrate 30 such as alumina having a low thermal capacity, high heat conduction property, electric insulation property, and in the form of an elongated flat plate-like and having a length of 270 mm, width of 7 mm and a thickness of 0.635 mm.

The heat generating resistor 5 having a resistance value of 34 Ohms in this example and of Ag/Pa or the like pattern-printed or sintered into a thin stripe longitudinally extended on a substantially central portion of a width of one of the surfaces of the heater substrate 30 (front side).

First and second electric energy supply electrode patterns 32, 33 of Ag or the like, are electrically connected with the opposite end portions of the heat generating resistor 5 by pattern printing and sintering on the surface of the heater substrate.

A surface protection layer 31 of the heater of heat resistive glass or the like is provided on the surface of the heater substrate to cover the heat generating resistor 5 except for the electrode pattern 32 and 33 portions.

A thermister 4 as a temperature sensing element is provided by pattern printing and sintering or bonding on a proper position on the other side (back side) of the heater substrate 30.

Two electroconductive path patterns 36 and 37 and third and fourth electrode patterns 38 and 39 are provided by pattern printing and sintering on the heater substrate, as signal supplying leads connected with thermister 4.

A temperature fuse 21 is provided on a proper part of the back side of the heater substrate by press-contacting with heat resistive adhesive material, as safety element.

The AC line is constituted by the heat generating resistor 5, and the first and second electrode patterns 32, 33 in the heater 6.

The DC line is constituted by thermister 4, electroconductive path patterns 36, 37 and third and fourth electrode patterns 38, 39 in the heater 6.

The first and and second electrode patterns 32, 33 in AC line are connected with electric energy supply contacts 34, 35 (FIGS. 3, 4) of unshown electric energy supply connector at the heater opposite end portions. The third and fourth electrode patterns 38, 39 of the DC line are connected with the A/D converter of the control system.

Across the first and and second electrode patterns 32, 33 of the AC line, the electric power is supplied by the electric energy supply contacts 34, 35 from the AC voltage source S through the AC driver 9, so that the heat generating resistor 5 generates heat over the total length thereof, thus quickly rise the temperature.

The rising temperature of the heater 6 is detected by thermister 4, and the sensed heater temperature information is supplied to the control means (CPU) 8 through the A/D converter 7 from the third and fourth electrode patterns 38, 39 of the DC line. The A/D converter 7 digitalizes the output of thermister 4 and then the digitalized signal is supplied to the control means 8.

The control means 8 controls the AC driver 9 including a TRIAC or the like on the basis of the input supplied thereto to control the energization electric power to the heat generating resistor 5 in the AC line, so that the surface temperature of the heater 6 is maintained at a predetermined heating temperature (fixing temperature). The target heater temperature of this example is 165° C.

For the electric power supply control of the heat generating resistor 5, the use is made with phase control, wave number control or the like. For example, in the wave number control, 14 waves of the AC input voltage are used as a basic unit, and the input electric energy is changed by changing the number of the waves of 14 waves to be supplied to the heat generating resistor 5. The ratio of ON/OFF is represented by a duty ratio and can be controlled in the range of 0–100%. (Heater Runaway)

The temperature fuse 21 as the safety element, has an operation temperature of 183° C. in this example, and is serially connected between the electric energy supply contact 34 for the first electrode pattern 32 of the heat generating resistor 5 and the AC driver 9, and contacted to the back side of the heater substrate 30. Designated by 40 (FIG. 3) is a heater receiving hole of the heater supporting member 3.

The temperature fuse 21 does not operate as long as the heater 6 is controlled at the predetermined target temperature, since it is not more than operation temperature of the temperature fuse 21.

Even if the temperature of the heater 6 rises significantly by overshooting upon starting beyond the target temperature, the temperature of the fuse does not rise to the operating temperature because thermal capacity of the temperature fuse 21 is relatively large, and therefore, the electric power supply to the heat generating resistor 5 of the heater 6 is not shut off.

When the heater 6 runs away, the temperature fuse 21 operates when the operation temperature of 183° C. is reached, to shut off the electric power supply to the heat generating resistor 5, thus prohibiting any problem.

Although the heater supporting member 3 is of thermoplastic resin material, it has the heat-resistivity of not less than 200° C., and is plasticized at not less than 250° C., so that the heat resistive range thereof is sufficiently higher than the target temperature of the heater 6 and the operation temperature of temperature fuse 21 so as to stably keep the function of the heater supporting member 3 without thermal deformation.

When the temperature fuse 21 failed at the time of heater runaway, so that the temperature fuse 21 is inoperable or is very slow in response, the heater 6 temperature continues the rise beyond the operation temperature of the temperature fuse 21 (overheating) without operation of temperature fuse 21.

In this case, however, when the heater 6 temperature reaches 250° C. which is the plasticization temperature of the heater supporting member 3, at least heater supporting surface (mounting surface) of the heater supporting member 3 is plasticized and fused by the heat of the over-heated heater 6.

Here, referring to FIG. 3, a is a length range where the pressing roller 2 is press-contacted to the heater 6 with the fixing film 1 therebetween; b is a width of the fixing film 1; and c is a length of the heater 6, wherein a<b<c is satisfied.

Therefore, the heater 6 is pushed in the range a corresponding to the roller length by the pressing roller 2. The length of the heater 6 is larger than the heater urging length range a provided by the pressing roller 2, and the opposite end portions of the heat generating resistor 5 of the heater 6 extend outwardly of the heater urging length range a provided by the pressing roller 2.

When the temperature of the heater 6 rises to not less than 250° C. under the heater 6 runaway condition and under the failure of the temperature fuse 21, the length range of the heater supporting member 3 corresponding to the heater urging length range a, inter alia, the neighborhood of the supporting surface for the heater, is plasticized and fused by the heat and the pressure with the result of the deformation due to the heat and pressure so that the heater mounting seat sinks.

On the other hand, the heater supporting member portion other than the range a, does not deform because of the lack of the pressure or heat generation or because of the insufficient temperature, and therefore, a deviation or step occurs relative to the range a. Then, a stress in the direction perpendicular to the surface of the heater 6 occurs at a position Z (a position substantially corresponding to each of the end portions of the pressing roller 2) corresponding to each of the ends of the range a. This is effective to disconnect the heat generating resistor 5 in the AC line to stop the electric power supply to the heat generating resistor 5, thus preventing the heater temperature from rising to as high as 400° C. Thus, in this example, the heater cracking can assuredly occurs at a predetermined position Z upon the overheating beyond the operation temperature of the temperature fuse 21 so that the overheating can be safely prevented without the necessity for the provision of the weakened portion at a predetermined position.

Therefore, the decrease in the yield when the heater is provided with a weakened portion for predetermining the heater cracking position, can be avoided.

The entirety of the heater supporting member 3 may be of a thermoplastic resin material to provide thermal deformation property, or thermal deformation property may be provided only for the heater supporting surface portion (heater mounting seat).

Figure 6:
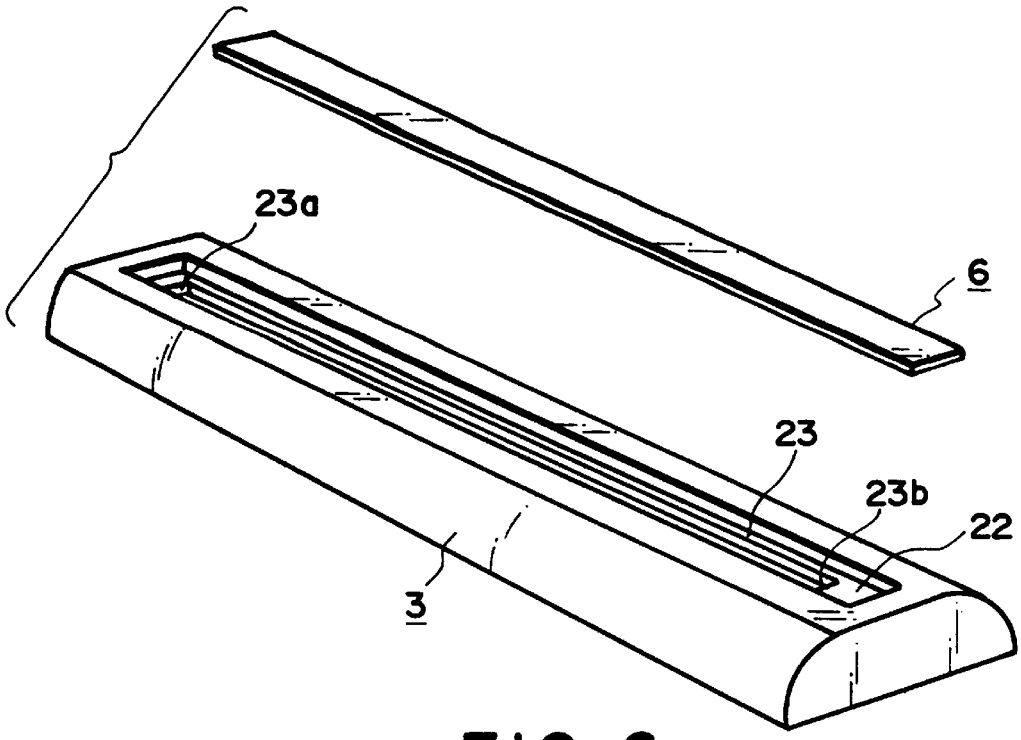
FIG. 6 is an exploded perspective view of a heater supporting member and a heater in another embodiment.
Figure 7:
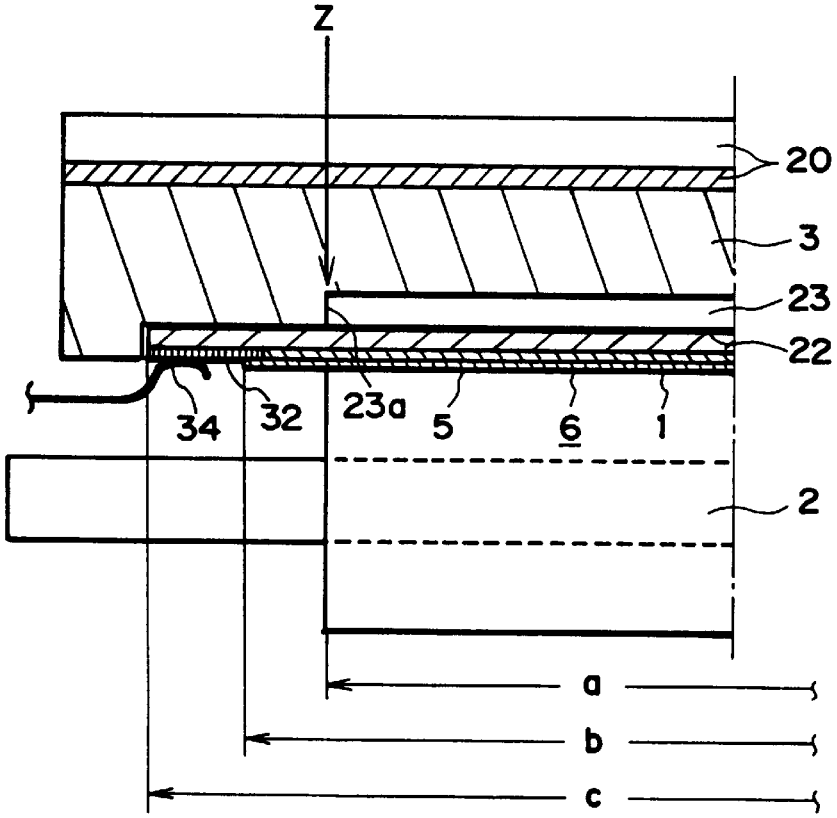
FIG. 7 is a longitudinal sectional view of a major part of an image heating device.

Embodiment 2 (FIGS. 6, 7)

In this example, the heater supporting member 3 is provided with an inside counterbore 23 by providing an additional recess in the counterbore 22 for the heater, as shown in FIG. 6.

With this structure, when the heater runs away with the result of overheating as in the foregoing, the neighborhood of the heater supporting surface of the heater supporting member 3 is plasticized and fused by the heat and pressure. In this case, the plasticized and fused portion deforms into the inside of the counterbore 23 so that the heater mounting seat can further sink. If the inside counterbore 23 does not extend to the longitudinal end portion of the counterbore 22 for mounting the heater, namely, if the counterbore 22 is provided only inside the heater 6 in the longitudinal direction, the stress perpendicular to the surface of the heater 6 is concentrated to the ends 23*a*, 23*b* of the inside counterbore 23. Thus, the heater is broken at the positions 23*a*, 23*b* (Z). By aligning the ends 23*a* and 23*b* of the hole 23 with the ends of the heater urging length range a provided by the pressing roller 2, the heater 6 is more easily broken at positions 23*a*, 23*b* when the heater runaway runs away.

As shown in FIG. 7, by align the ends of the inside counterbore 23 of the heater supporting member 3 with the end surfaces of the pressing roller 2, the stress by the pressing force of the pressing roller 2 and the stress due to the difference in the heat conduction to the heater supporting member 3 are concentrated on the portion, thus cracking promoting the heater 6 to crack.

Embodiment 3

In this example, non-fusible member (not plasticized by heat) is provided in the heater supporting surface portion of thermoplastic heater supporting member 3, in the structure of embodiment 1 or 2.

When the heater 6 temperature continues to rise without operation of the safety fuse 21 at the time of the heater 6 running away, the heater supporting surface (the mounting seat of the heater) of the heater supporting member 3 is plasticized and fused, as has been described hereinbefore, and therefore, it sinks. But, it does not sink at the non-fused member portion, and therefore, the forces are applied to the both sides of the heater with the non-fused member portion functioning as a fulcrum, so that the breakage or rupture occurs at the fulcrum portion.

Figure 8:
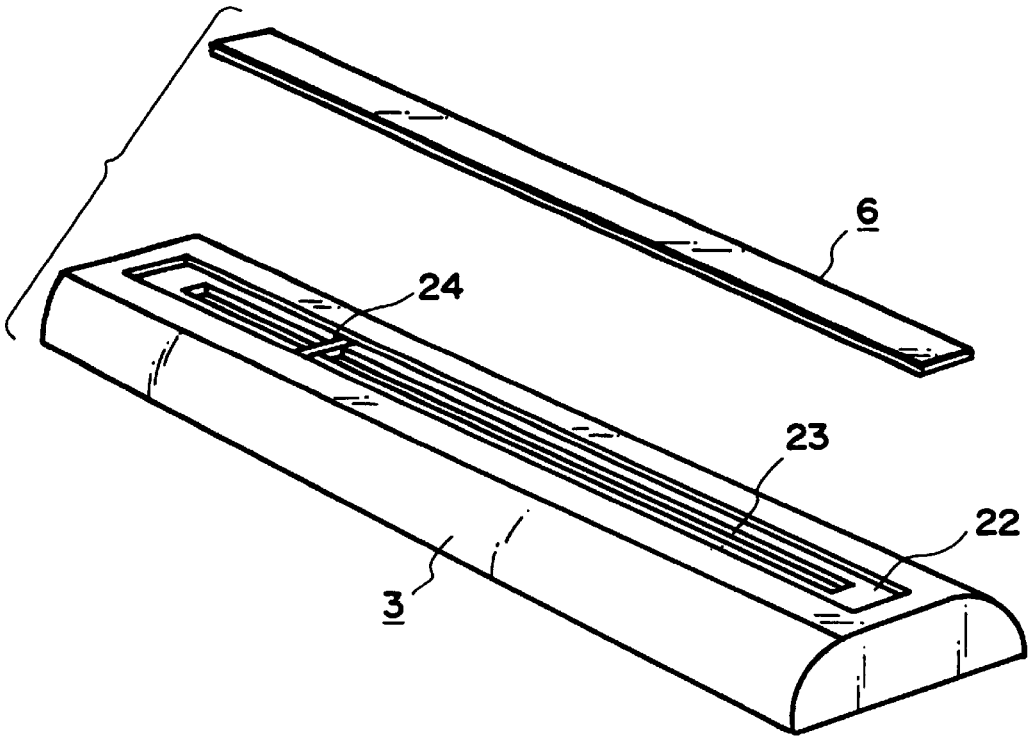
FIG. 8 is an exploded perspective view of a heater and heater supporting member in a further embodiment.

FIG. 8 shows this example, wherein a non-fusible portion material 24 is placed in the inside counterbore 23 in the structure of embodiment 2 having the inside counterbore 23.

When the heater 6 length is 270 mm, and the width thereof is 7 mm, it is preferable that the nonfused member 24 has a contact width relative to the heater 6 not more than 1 mm, or it is further preferable that the contacting end is in the form of an edge. This is because the edge configuration is effective to concentrate the pressure more, thus further assuring the cracking of the heater 6. The contact position relative to the heater 6 suffices if the it is between a position 30 mm away from the heater end portion and the center portion thereof. If it is too close the end, the heater is supported at 2 positions since the heater supporting member does not fuse at the end portions of the heater 6. In this case, the heater is not easily cracked.

Such a non-fused member 24 may be of a material having a heat-resistivity and not having thermoplastic property, such as thermosetting polyimide, polyamide-imide, polyamide, phenolic resin, ceramic or the like, preferably. Particularly, it preferably is electrically insulative material to prevent electric conduction after the heater 6 cracks. It further preferably has a larger thermal-expansion than the heater supporting member 3.

Under the normally state, the non-fused member 24 is contacted to the heater 6 or disposed with a clearance not more than 0.1 mm therefrom. When the heater supporting member 3 starts to fuse, the heater 6 is pushed by the pressing roller 2 at the both sides with the non-fused member 24 functioning as a fulcrum in the counterbore 22. By this, the heater 6 breaks at the position of the non-fused member 24.

In the above-described embodiments, the use is made with thermoplastic property of the supporting member. The description will now be made as to an embodiment wherein the heater is broken using thermal-expansion of the heater per se.

Embodiment 4

In this example, the heater cracking position is determined using thermal-expansion of the heater 6 in the longitudinal direction.

When the substrate 30 for the heater 6 is made of alumina base material, thermal expansion coefficient thereof is $7.2\times 10^{-6}$/° C., and the heater 6, having the length of 270 mm, expands by 0.7 mm in response to the temperature rise from the room temperature to 400° C. in calculation. On the other hand, the heater supporting member 3 does not expand so much since the temperature thereof does not follow the rapid temperature rise. Therefore, it is possible to determine the cracking position by applying the stress to a part of the heater, using the difference in the expansion.

Figure 9:
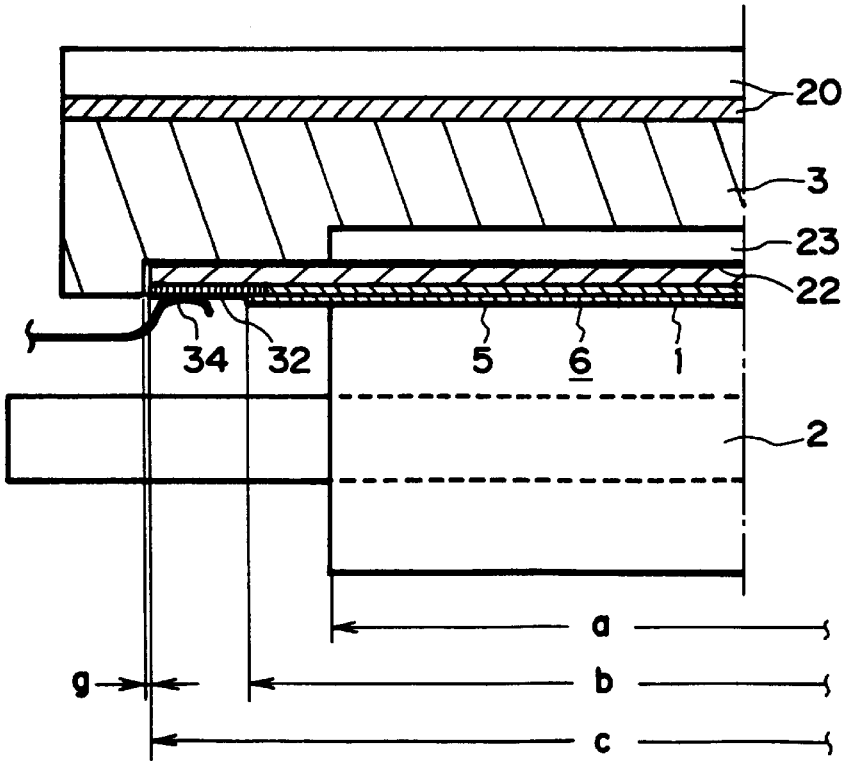
FIG. 9 shows a relation between the heater and the heater supporting member end portion in a further embodiment

More particularly, when the gap is provided in the longitudinal direction between the heater supporting member and the heater, as shown in FIG. 9, the gap g is made not more than 0.7 mm, and the gap is provided in one way. The gap are not equal at the both sides, but is smaller at one end. By doing so, it first abuts adjacent the smaller gap position to apply a stress to the heater. Particularly, at the central portion of the heater, as shown in FIG. 3, the heater is prevented from deforming by the pressing roller 2 so that the heater cracking tends to occur at heater opposite end portions not pressed. In view of this, the gap at which the heater cracking is desired, is made smaller, and the portion extended from the pressing roller contact region is made longer, so that the heater cracking position can be determined at one of the ends.

By this, even if the heater is broken by the heater running away, the insulation between the AC line and thermister can be maintained.

In the normally state, the temperature of the heater 6 is not more than 250° C., and therefore, and at this time, heater supporting member 3 is prevented from abutment by the gap of not less than 0.3 mm.

Embodiment 5

In embodiment 4, the longitudinal thermal-expansion of the heater 6 is used. In embodiment 5, a warpage due to the heat in the width direction of the heater 6 is used to specify heater 6 cracking position at which the heater is broken.

Figure 10:
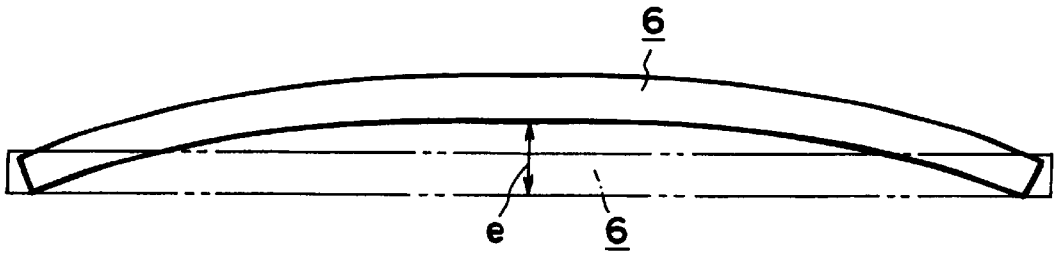
FIG. 10 is a top plan view (exaggerated view) of a heater involving warpage in a width direction.

Normally, the heater 6 deforms with temperature rise in the width direction into a sector-like form by the temperature rise, as shown in FIG. 10 with exaggeration. This is because the center of the heat generation of the heater 6 is deviated from the physical center of the heater, or because the center portion of the fixing nip N and the center portion of the distribution of the heat generation are deviated from each other, in most cases. The deviation may be deliberately given in the design, or may occur due to manufacturing tolerances.

Figure 11:
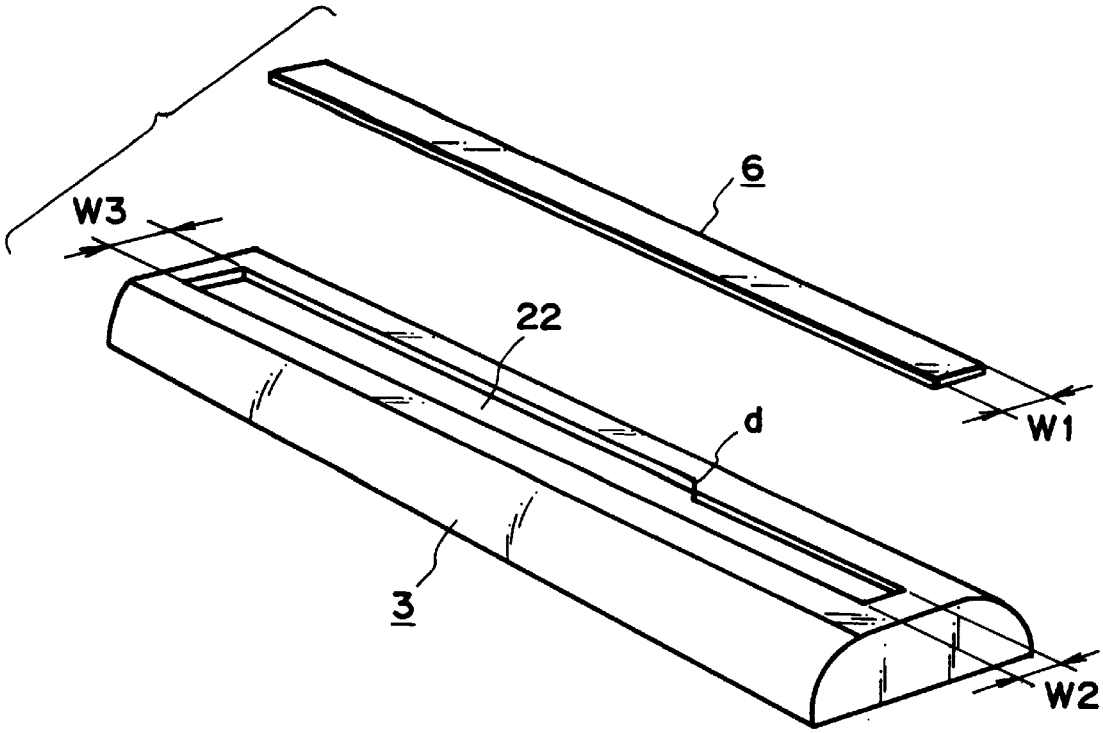
FIG. 11 is an exploded perspective view of a heater and a heater supporting member in a further embodiment.
Figure 12:
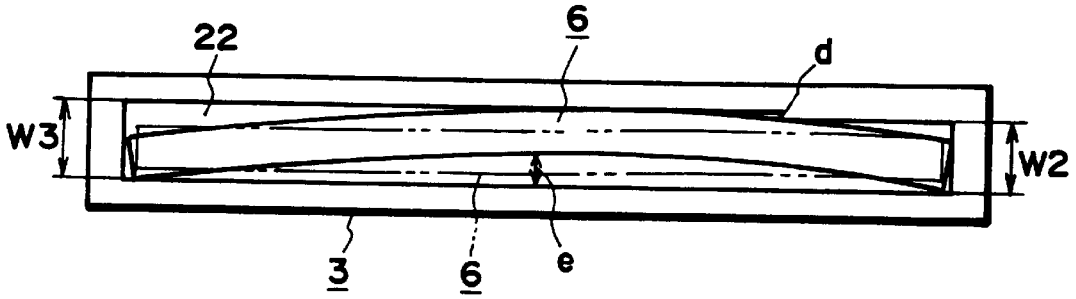
FIG. 12 is an illustration of a heater cracking position.

In this example, the cracking of the heater 6 is caused upon the heater running away, using the warpage e of the heater in the width direction. When the heater 6 deforms as shown in FIG. 10, the configuration of the heater mounting surface of the heater supporting member 3 (flat surface configuration of the counterbore 22) is formed as shown in FIGS. 11, 12. Namely, the width W2 is slightly larger than width W1 of the heater 6, and is much larger than the width W3 in the other portion. Designated by d is a boundary portion between the width W2 portion and width W3 portion of the counterbore 22, and is in the form of a step corner (corner of the heater mounting seat). Thus, a step d is formed at the longitudinal end of the counterbore 22.

When the heater 6 deforms in the width direction as shown in FIG. 12 (FIG. 10) by the over-heating, the corner d is abutted, and the stress is concentrated there with the result of cracking of the heater 6.

The actual measurement has revealed that the warpage e of the heater 6 in the width direction was 0.5 mm at the maximum when the heater width W1=7 mm, and W2 was set to 7.3 mm (W2−W1=0.3 mm), and W3 was set to 7.7 mm (W3−W1=0.7 mm). The point d was located in a range of 105 mm from the center portion.

By this, upon the heater running away, the stress is concentrated on the d point of the heater 6 to positively permit the heater 6 to crack.

In this example, the point d is provided one of the end portions, but a portion of width W2 may be provided at the opposite end sides to remove the gap in the width direction of the heater. When an A4 size sheet is fed longitudinally, the heat generating resistor 5 of the heater 6 is about 105 mm toward the both sides from the sheet feeding center (center portion reference transportation), and the warpage of the heater 6 is remarkable within the range of this length from the center portion, and therefore this position is preferable. When B4 size sheet is fed longitudinally, the d point is preferably located within 129 mm from the center of sheet feeding. In the case of lateral feeding of A4 size sheet, it is preferably set at a position within 149 mm from the center portion.

Further, the width of the heater receiving surface of only one end of the heater supporting member may satisfy:

W3>W2>W2>W1

In this case, left and right ends are not the same.

Upon the breakage of the heater 6 upon the heater running away, the insulation between the AC line and thermister is kept.

In this case, also, sufficient gap is provided to avoid abutment of the heater 6 to the supporting member 3 at the temperature not more than 250° C., and it is 0.3 mm, in this embodiment.

In the embodiments 1–5, the heater 6 is given the stress to crack the heater. The description will be made as to an example wherein the reliability of the temperature fuse is high, and the operation of the temperature fuse 21 is assured without cracking the heater by the stress. There is provided a gap which is larger than thermal-expansion amount of the heater 6 resulting from the temperature change from normal temperature of 25° C. to 40° C., between the heater supporting member and the heater.

Figure 13:
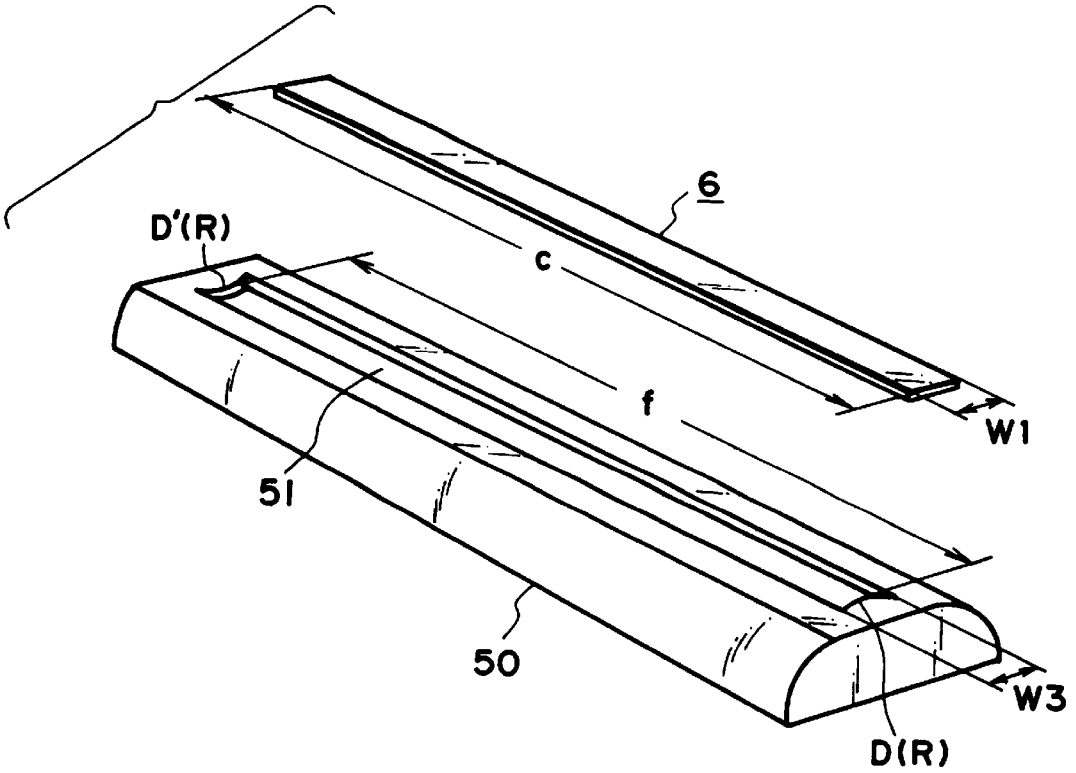
FIG. 13 is an exploded perspective view of a heater and a heater supporting member in a reference example.

FIG. 13 shows this example, the heater mounting surface (heater mounting counterbore 51) of the heater supporting member 50 has sufficient width direction play, (W3−W1)>0.7 mm, and a length direction play, (f−c)>0.7 mm.

At the end portion D, D's of the heater mounting surface, R is provided, and even if the abutted heater is deformed, the corner of the heater can escape so that no stress is given to the heater 6. The R is determined in this case, in the following manner:

The warpage of the heater 6 can be approximated to a circular section, and therefore, the curvature R', the center angle θ are:

R'θ=135 mm:

R'−R' cos θ=0.5 mm

Here, 135 mm is ½ of the heater length c of=270 mm, and 0.5 mm is a warpage degree e of the heater 6 in the width direction.

Then, θ is nearly equal to '0.0024π, and R'=17904 mm

Therefore, the inclination of the heater end portion is w1θ=0.052 when the W1=7 mm, and the R of the end portion D, D' of the heater supporting member 3 will suffice if this inclination can be absorbed.

Figure 14:
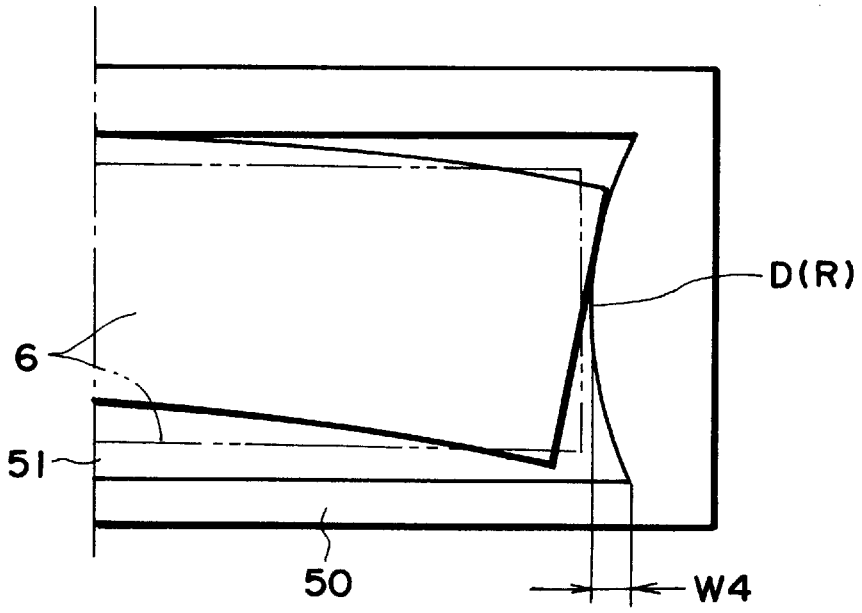
FIG. 14 is an enlarged schematic view of one end side of the device shown in FIG. 13.
Figure 15:
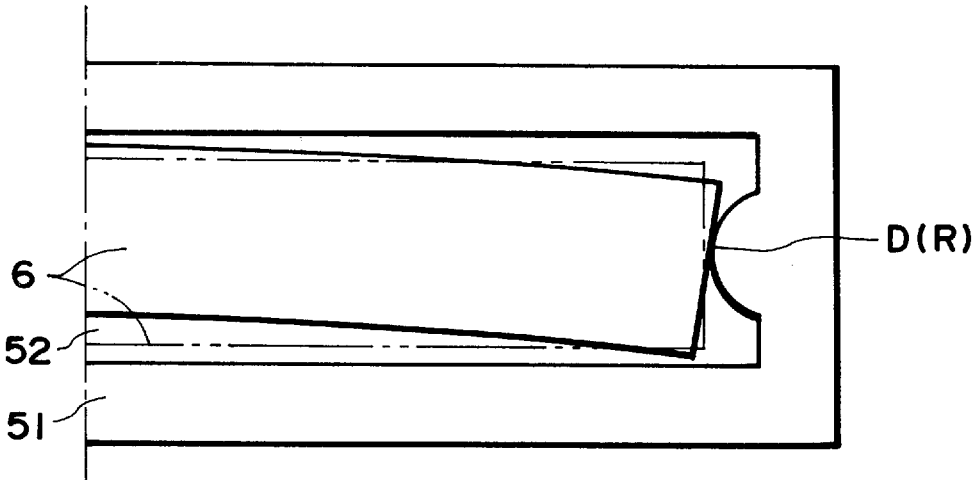
FIG. 15 shows a structure of the device of another reference example.

Actually, however, the heater 6 per se may incline in the mounting seat 51 of the heater supporting member 50 in some cases, and therefore, it is preferable that the difference W4 (FIG. 14) between the projected portion of the R and the end portion is not less than 0.5 mm. For example, the arcuation having a radius of 10.5 mm and having a center at a position 10 mm away from the end of the counterbore 51 of the heater supporting member 50, may be the end surface of the counterbore 51. In FIG. 14, the R (rounding) is formed in the entire region in the width direction of the heater, but if a semicircular R is formed in the central portion, it is effective, so that the configuration shown in FIG. 15 is usable, wherein it is line in the other portions. By this, the temperature fuse operates without the heater, so that the power supply can be assuredly stopped.

Figure 16A:
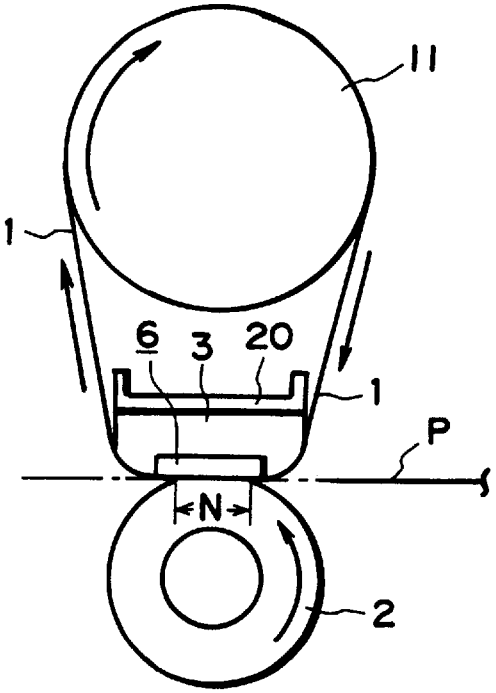
FIG. 16, (a), (b) and (c), show structures of film type heating devices of further examples.
Figure 16B:
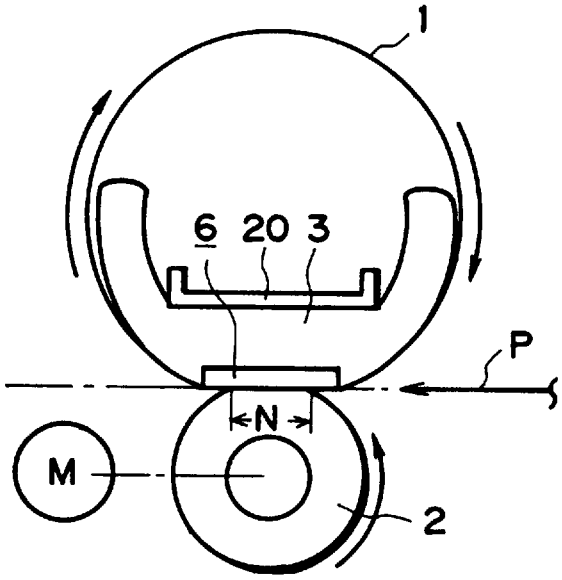
Figure 16C:
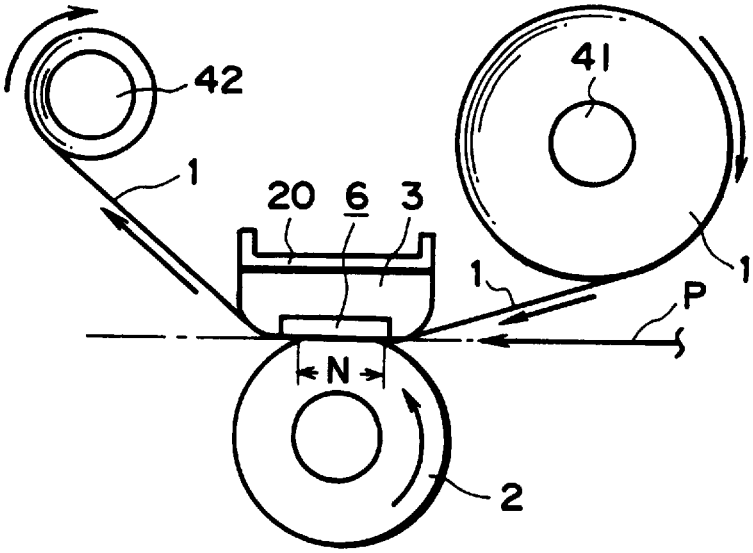

FIG. 16, (a), (b), and (c), show other examples of heating devices of film heating type, to which the present invention is applicable.

In (a), an endless belt type heat resistive film 1 is stretched and extended around the two members, namely, a driving roller 11 and a heater 6 supported on a heater supporting member 3, and is moved by the driving roller 11.

In (b), a cylindrical heat resistive film 1 is loosely extended around a heater supporting member 3 which also functions as a film guide, and the film 1 is press-contacted to the heater 6 by the pressing roller 2. By rotating the pressing roller 2, the film 1 is rotated while the inner surface of the film 1 is in sliding contact with the heater 6 surface (pressing roller driving type).

In (c), heat resistive film 1 is a non-endless film rolled around a feeding shaft 41, and is fed to the take-up shaft through the heater 6 at a predetermined speed.

The heating device of the present invention is applicable not only to the image heat-fixing device A in the foregoing embodiments, but also to an apparatus for heating a recording material carrying an image to improve the surface property (gloss or the like), to an apparatus for temporary fixing an image, to a drying or laminating apparatus applying heat to a fed sheet-like material.

The present invention is applicable to a device or the like wherein a heating element supported on a heater supporting member is directly contacted to a member to be heated.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater including a base, and a heat generating element, on said base, for generating heat upon electric energization;

a supporting member for supporting said heater;

a back-up member provided within a length of said heat generating element;

wherein said supporting member and said back-up member are urged toward each other with said heater interposed therebetween, and wherein a recording material carrying an image is passed through between said heater and said back-up member so that the image is heated;

wherein said supporting member includes a supporting portion of a thermoplastic material for supporting said heater and a non-thermoplastic portion on said supporting portion, and said non-thermoplastic portion has a length smaller than that of said heat generating element and is provided within the length of said heat generating element.

2. An apparatus according to claim 1, wherein said heat generating element is provided within a length of said base.

3. An apparatus according to claim 2, wherein said heater has an electrode for electric energization at a longitudinal portion of said heat generating element.

4. An apparatus according to claim 1, wherein said back-up is provided at each side within a length of said heat generating element.

5. An apparatus according to claim 1, wherein said heater is extended in a longitudinal direction of said base.

6. An apparatus according to claim 1, wherein the base is a ceramic substrate.

7. An apparatus according to claim 1, wherein said thermoplastic material is of thermoplastic resin material.

8. An apparatus according to claim 7, wherein said thermoplastic resin material is liquid crystal polymer or PPS material.

9. An apparatus according to claim 1, wherein said supporting member is entirely composed of thermoplastic material.

10. An apparatus according to claim 1, wherein said thermoplastic material is plasticized at a temperature not less than 250° C.

11. An apparatus according to claim 1, wherein said supporting member is provided with a recess which is recessed away from said heater.

12. An apparatus according to claim 11, wherein said recess is provided within said heater width.

13. An apparatus according to claim 12, wherein said back-up member ends at a position of an end of said recess.

14. An apparatus according to claim 1 wherein said non-thermoplastic portion a is of thermosetting resin material.

15. An apparatus according to claim 1, wherein the non-thermoplastic portion has a thermal expansion coefficient larger than that of the other portion of the supporting member.

16. An apparatus according to claim 1, wherein a film is provided between said heater and said back-up member, wherein one side of said film is in sliding contact relative to said heater, and the other side of said film is moved together with and in contact with a recording material carrying an image.

17. An apparatus according to claim 16, wherein the image is fixed on the recording material by the heat from said heater through the film.

18. An apparatus according to claim 1, wherein said back-up member is in the form of a pressing roller.

19. An image heating apparatus, comprising:

a heater including a base and a heat generating element, on said base, for generating heat upon electric energization, wherein an image on a recording material is heated by heat from said heater;

a supporting member for supporting said heater, said supporting member being provided with a longitudinal recess into which said heater is engaged;

wherein said recess has at least one stepped portion at a lateral end, and said recess has widths which are different before and after the stepped portion.

20. An apparatus according to claim 19, wherein there are provided a plurality of such steps.

21. An apparatus according to claim 19, wherein said base is a ceramic substrate.

22. An apparatus according to claim 19, further comprising a film in sliding contact with said heater, and a back-up member for forming a nip with said heater with the film therebetween, and a recording material carrying the image is fed by the nip, and wherein the image is fixed on the recording material by the heat from the heater through the film.

23. An apparatus according to claim 19, wherein said stepped portion is provided within a length of said heat generating element.

24. An image heating apparatus, comprising:

a heater including a base and a heat generating element, on said base, for generating heat upon electric energization;

a supporting member for supporting said heater; and a back-up member provided within a length of said heat generating element;

wherein said supporting member and said back-up member are urged toward each other with said heater interposed therebetween, and wherein a recording material carrying an image is passed through between said heater and said back-up member so that the image is heated;

wherein said supporting member includes a supporting portion of a thermoplastic material for supporting said heater and a recess which is recessed away from said heater, wherein said back-up member ends at a position of an end of said recess.

25. An apparatus according to claim 24, wherein said base is a ceramic substrate.

26. An apparatus according to claim 24, wherein said back-up member is in the form of a pressing roller.

27. An apparatus according to claim 24, further comprising a film for sliding contact with said heater, and wherein said heater and said back-up member form a nip with said film therebetween, and a recording material carrying an unfixed image is passed through the nip so that the unfixed image is fixed by heat from said heater.

28. An image heating apparatus, comprising:

a heater including a base and a heat generating element, on said base, for generating heat upon electric energization, wherein an image on a recording material is heated by heat from said heater; and a supporting member for supporting said heater, said supporting member being provided with a recess into which said heater is engaged, wherein said base and said recess are out of contact from each other, and are brought into contact by deformation upon abnormal temperature rise.

29. An apparatus according to claim 28, further comprising a back-up member provided within a length of said heat generating element, wherein said supporting member and said back-up member are urged toward each other with said heater therebetween.

30. An apparatus according to claim 28, wherein said base is ceramic substrate.

31. An apparatus according to claim 28, further comprising a film in sliding contact with said heater, and a back-up member for forming a nip with said heater with the film therebetween, and a recording material carrying the image is fed by the nip, and wherein the image is fixed on the recording material by the heat from the heater through the film.

* * * * *

UNITED STATES PATENT AND TRADEMARK OFFICE

CERTIFICATE OF CORRECTION

PATENT NO. : 5,860,052

DATED : January 12, 1999

INVENTOR(S) : YASUMASA OHTSUKA, ET AL.

It is certified that error appears in the above-identified patent and that said Letters Patent is hereby corrected as shown below:

COLUMN 4,
Line 49, "PES" should read --PES,--.

COLUMN 6,
Line 4, "rise" should read --raising--.

COLUMN 8,
Line 1, "align" should read --aligning--;
Line 12, "embodiment" should read --Embodiment--;
Line 25, "embodiment" should read --Embodiment--;
Line 47, "normally" should read --normal--;
Line 55, "the" (second occurrence) should be deleted; and
Line 56, "with" should read --of the--.

COLUMN 9,
Line 10, "are" should read --is--; and
Line 23, "normally" should read --normal--.

COLUMN 10,
Line 1, "provided" should read --provided at--;
Line 17, "W2>" (first occurrence) should be deleted;
Line 40, "D's" should read --D'--; and
Line 54, "17904mm" should read --17904mm.--.

UNITED STATES PATENT AND TRADEMARK OFFICE

CERTIFICATE OF CORRECTION

PATENT NO. : 5,860,052

DATED : January 12, 1999

INVENTOR(S) : YASUMASA OHTSUKA, ET AL.

It is certified that error appears in the above-identified patent and that said Letters Patent is hereby corrected as shown below:

COLUMN 11,
Line 27, "temporary" should read --temporarily--.

COLUMN 12,
Line 22, "claim 1" should read --claim 1,--.

Signed and Sealed this

Twenty-sixth Day of October, 1999

*Attest:*

Q. TODD DICKINSON

*Attesting Officer*

*Acting Commissioner of Patents and Trademarks*